United States Patent [19]

Huemer

[11] Patent Number: 4,579,149

[45] Date of Patent: Apr. 1, 1986

[54] CIRCULAR LOOM

[76] Inventor: Franz X. Huemer, Sonnenuhrgasse 4, 1060 Vienna, Austria

[21] Appl. No.: 630,595

[22] Filed: Jul. 13, 1984

[30] Foreign Application Priority Data

Jul. 20, 1983 [CH] Switzerland ..... 3967/83

[51] Int. Cl.[4] ..... D03D 37/00

[52] U.S. Cl. ..... 139/13 R

[58] Field of Search ..... 139/11, 13 R, 16, 436

[56] References Cited

U.S. PATENT DOCUMENTS

| | | | |
|---|---|---|---|
| 951,449 | 3/1910 | Petersen | 139/13 |
| 1,889,076 | 11/1932 | Mutter | 139/13 |
| 2,487,148 | 11/1949 | Latieule et al. | 139/13 |
| 4,479,517 | 10/1984 | Plammer | 139/13 |

*Primary Examiner*—Henry S. Jaudon

*Attorney, Agent, or Firm*—Karl F. Ross; Herbert Dubno

[57] ABSTRACT

With the circular loom, a plurality of partial healds are arranged circularly around a main shaft of the loom, and each comprises a plurality of inner and outer yarn guiding eyes for the guidance of a part of the two systems of warp yarn distributed all around, and which are given a countercurrent up-and-down motion for the formation of the weaving or travelling shed by sequential means, which engage a plate cam on and revolving with said main shaft of the loom. The inner or outer yarn guiding eyes are connected together by band means, each of which is guided over upper or lower guide rollers. The sequential means comprise at least one two-armed control lever for the activation of the countercurrent up-and-down alternating motion on the yarn guiding eyes of each partial heald, the control lever being supported and turning on a fixed fulcrum, and being, with the end of one of its arms, in operative connection with a cam on the plate cam, and which is fastened with the end of its other arm to the inner strand of the band means of the respective partial heald. These measures permit the construction of a shaft driving device which is practically maintenance-free, of high operating frequency and functionally reliable.

5 Claims, 5 Drawing Figures

CIRCULAR LOOM

FIELD OF THE INVENTION

The present invention relates to a new and improved circular loom.

More specifically, the invention relates to a circular loom consisting of a plurality of partial healds arranged circularly around a main shaft of the loom, and each comprising a plurality of inner and outer yarn guiding eyes for the guidance of a part of the two systems of warp yarn distributed all around the shaft, and which are given a countercurrent up-and-down motion for the formation of the weaving or travelling shed by sequential means, which engage a plate cam on and revolving with the main shaft of the loom, the inner or outer yarn guiding eyes being connected together by band means, each of which is guided over upper or lower guide rollers.

BACKGROUND OF THE INVENTION

Hitherto known circular looms, in which inner and outer partial healds were disposed circularly in two rows around a main shaft of the loom, and moved up and down by means of two rows of control levers by a plate cam rotating with the main shaft of the loom, are provided with only one row of stationary partial healds for the reduction of the moved elements of the change of shed means, each having a plurality of inner and outer yarn eyes for the warp threads, which are fastened in pairs on the strands by endless strings or band means. The endless strings of the respective groups on each partial heald are guided together or individually around two rollers, which are spaced apart from each other. Here, all inner strings of the strands are fastened at their lower regions onto a vertical slide, which is moved up and down by scanner rollers and a cam on the plate cam, whereby a countercurrent up-and-down alternating motion is conveyed onto the endless strings and hence onto the yarn guiding eyes, thus forming the travelling shed.

By means of the reduction of the partial heald means to a "single-row" construction, the number of moved control components have been able to be substantially reduced, whereby new difficulties have arisen, as, in particular, the fact that the vertical slide tends to cant and, thereby, to jam, owing to the effect of the high radial and tangential force thereon from the scanner rollers coming from the cam, which can only be controlled by considerable equipment.

OBJECTS OF THE INVENTION

It is the primary object of the present invention to provide a new and improved construction of a circular loom, which, with the avoidance of the described disadvantages of the prior art, fullfils all present-day requirements.

Another and more specific object of the present invention is to provide an arrangement of the previously mentioned type, which permits the control movement of the cam to be conveyed in a simple and trouble-free manner onto the up-and-down moving band means.

SUMMARY OF THE INVENTION

There and still further objects of the invention, which will become more readily apparent as the description proceeds, are achieved with the present invention in which the sequential means comprise at least one two-armed control lever for the activation of the countercurrent up-and-down alternating motion on the yarn guiding eyes of each partial heald, the control lever being supported and turning on a fixed fulcrum, and being, with the end of one of its arms, in operative connection with a cam on the plate cam, and which is fastened with the end of its other arm to the inner strand of the band means of the respective partial heald.

By means of these measures, it is now possible, with elimination of the no doubt extremely precise but also very expensive vertical slide arrangement, to achieve a further simplified conception of such an arrangement, based on the face that the band means of the partial healds require indeed a precise guidance in the vertical direction but not necessarily a lateral guidance in the horizontal direction, which, therefore, permits the utilization of control levers.

The required precise vertical guidance can thereby be further improved by forming the operative connection between the end of the one arm of the control lever and the lever cam of the plate cam or a form-closed forced control, i.e. a form fitting force transmitting coupling.

For a wear-resistant forced control, an advantageous feature provides that the control lever comprises at least one rolling-off sequential roller, which rolls on the lever cam on the plate cam at the end of its arm that is in operative connection with the lever cam.

Further, the arrangement can alternatively be such that the control lever is a linear lever, or an angle or toggle lever, which permits the lever cam on the plate cam to be developed, for example, as a circular groove in the shell of the plate cam or as a lateral or downwardly or upwardly projecting flange.

A great, relatively firm lateral stability of the whole arrangement as well as a further simplified conception is, moreover, achieved when the control lever is flexibly connected with the end of its arm that is fastened to the inner strand of the band means of the respective partial heald to a crossbar, which makes the contact with or is fastened to the band means, by means of a joint.

By means of the fast sequential motion on the control lever resp. on the inner band strand, and of the thereby ensuing constant deflection against the other strand, lateral vibrations are greatly damped.

If it is desired to prevent these deflections of the inner strand, then this can be achieved with advantage by a connecting rod or a connecting lever being disposed between the joint on the crossbar and the respective control lever arm.

BRIEF DESCRIPTION OF THE DRAWING

The invention will be better understood and objects other than those set forth above, will become apparent when consideration is given to the following detailed description thereof. Such description makes reference to the annexed drawing wherein.

SPECIFIC DESCRIPTION

Figure 1:
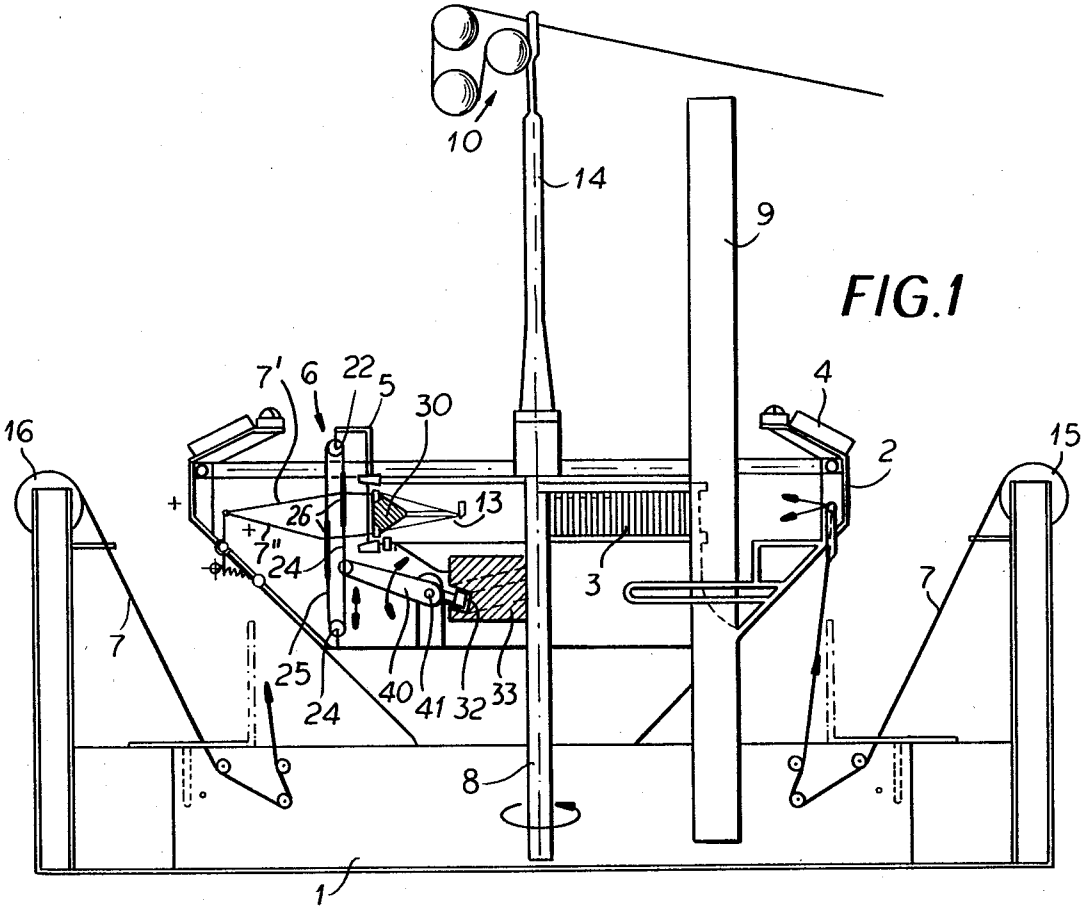
FIG. 1 is a schematic side elevation of a circular loom.

The circular loom according to FIG. 1 in known manner, rests on a loom base 1, which supports a circular frame carrier 2, and is provided with a circular reed 3, an on/off switch 4 for the loom and further frame portions 5 for the support of shafts 6. These shafts 6 are in generally known manner arranged in a circle around the main shaft 8 of the loom, as is described below in greater detail.

Furthermore, the support 9 for the cloth draw-off mechanism is supported on the loom base 1, which is here indicated only by the cloth draw-off rollers 10. A fabric spreader 14 is also disposed in the draw-off area. Further, in the circular loom illustrated, it is also possible to see the draw-in rollers 15 for the warp threads on the left-hand side and the draw-in roller 16 for the warp threads on the right-hand side. These warp threads 7, the course of which is only indicated, are divided into two warp thread gatherings and are drawn off in the known manner by groups of warp thread spools, which are not illustrated more closely here. For the formation of the weaving shed, one of these thread gatherings is lifted up while the other is guided down from the level of the weaving plane through the so-called change of shed motion, so that a warp top shed 7' and a warp lower shed 7'' result. In this so-called weaving or multiphase shed, at least one shuttle 30 with a weft yarn bobbin, not shown here, is passed through on a horizontal circular path. Owing to the circular motion of the shuttle, the weft yarn wound off from the weft yarn bobbin is transferred onto the edge 13 of the circular fabric, so that this weft yarn can be woven into the fabric. The tubular weave can then be drawn off and laid together as a flat tubular fabric.

In order to produce the previously-mentioned shed-forming operation, a plurality of healds 6 are arranged in a circle around the main shaft 8 of the loom near the outer mantle surface of the circular reed 3. As can be seen in FIG. 1, each heald 6 comprises, for example, partial healds 24 and 25, being formed by belt strands. For example, an endless belt can, for this purpose, be guided over each of the rotatably supported guide pulleys 22 or 23 on the upper or lower part of the frame 5.

The inner strand 24 and the outer strand 25 of the belt have in each case yarn guiding eyelets 26, through each of which a warp thread 7 of one or the other of the warp thread gatherings 7' or 7'' is pulled. The making of a countercurrent up-and-down alternating motion of the strands 24 and 25 of the belt produces, then, the previously-mentioned change-of-shed motion of both warp thread gatherings.

To the extent described above, the construction of the circular loom corresponds to the prior art, so that further explanation of such a loom is unnecessary.

The problem that is to be taken into consideration here on such a circular loom involves the arrangement of the means for the formation of the change of shed motion on both of the warp thread gatherings.

For this alternating motion, it is known that preferably the inner strand 24 is tightly connected below the yarn guiding eyes 26 with a so-called shuttle slide 29 (not shown more closely here), which is slidable up and down on movement control means. Projecting from this vertical slide are guide rollers, which are supported by means of a respective cam, revolving on a corresponding plate cam, which is central with the main shaft of the circular loom. It has been found, however, that the known means for vertically sliding the shaft sliding frame up and down, for example in the form of sliding pieces on rods, which are arranged secured to the shaft sliding frame, are subject to a high degree of wear, which cannot be positively reduced even with a great deal of lubrication. Accordingly, such arrangements stand in the way of a higher machine frequency. Moreover, the sliding guides tend to cant. This all necessitates high quality fabrication requirements in order to obtain results of at least some usable degree.

Figure 2:
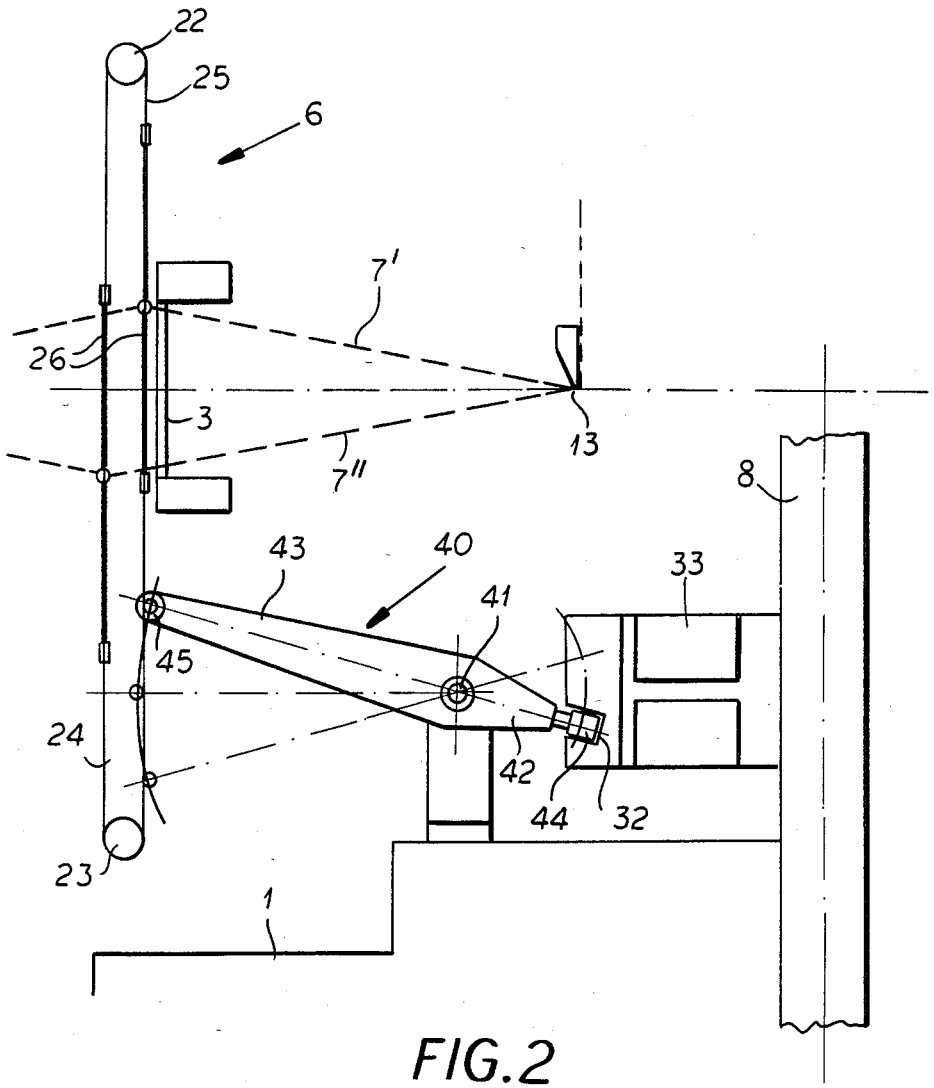
FIG. 2 is a schematic representation on a larger scale of the partial heald control means of the loom according to FIG. 1.

In order to remedy this problem according to invention, for creating the countercurrent up-and-down motion on the thread eye means 26 for each partial heald 6, to arrange at least one two-armed control lever 40, which is supported and turns on a fixed fulcrum 41, and which, with the end of one of its arms 42, is in operative connection with a cam 32 on the plate cam 33, and which is fastened with the end of its other arm 43 to the inner strand 24 of the band means 23, 25 of the respective partial heald 6, as is shown in particular in FIGS. 1 and 2.

It is to be mentioned at this point, that the measures according to invention do not depend upon how the partial healds or the thread eye means, which are moved by the control lever 40, are actually constructed. For example, the thread eye means 26 according to FIG. 2 can be single healds, of which a plurality are gathered to a partial heald (not shown in detail), and, onto which, bands 24, 25, which are guided round the guide rollers 22, 23, engage, with the inner strands of the lower bands being connected together with the end of an arm 43 of a single partial heald control lever 40. According to a suggestion made by the same applicant, the inner or outer thread eyes of each partial heald can penetrate the respective strand of an endless guided band, which extends over the width of the partial healds and over each guide roller, which are supported and can turn on the upper or lower frame part of the partial healds, with each thread eye in the one strand lying opposite a vertical slit in the other strand, and with the control lever engaging preferably the inner strand of the band, in this case, below its eye and vertical slit.

Such a partial heald construction is, however, the object of another patent application by the same applicant, and does not have to be elucidated here.

FIG. 2 clearly shows, moreover, that the operative connection between the end of the one arm 32 of the plate cam 33 is created by a form-closed forced control. According to FIG. 2, the control lever 40 is here, by way of example, arranged as a linear lever, comprising at least one rolling-off sequential roller 44, which rolls on the cam 32 on the plate cam 33, at the end of its arm 42 that is in operative connection with the cam 32, said sequential roller being here immersed in a groove 32, which is formed in the shell of the plate cam 33.

If, on the other hand, an angle or toggle lever is employed as control lever 40, then the control lever arm concerned can engage in a face-side groove or engage with a double roller on a downward or upward projecting control flange, which is here not described in more detail.

Figure 5:
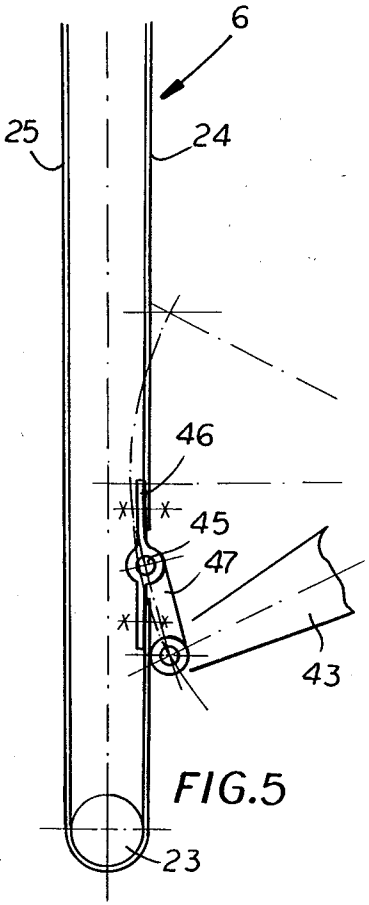
FIGS. 3, 4 and 5 are schematic representations on a larger scale of a partial view of several specific embodiments of the partial heald control means according to FIG. 2.
Figure 4:
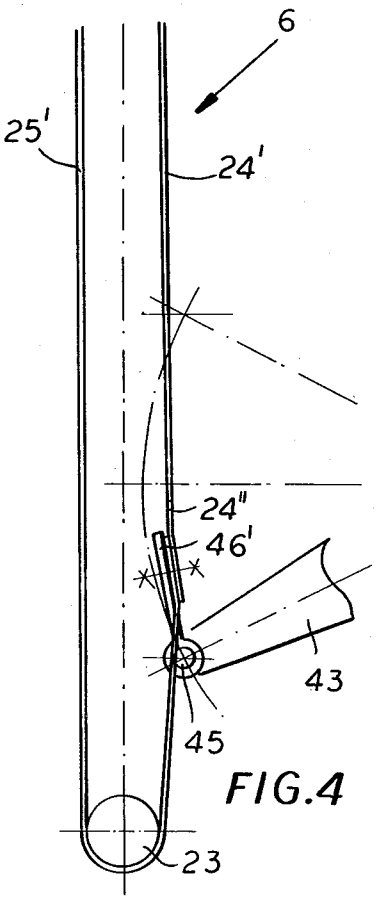
Figure 3:
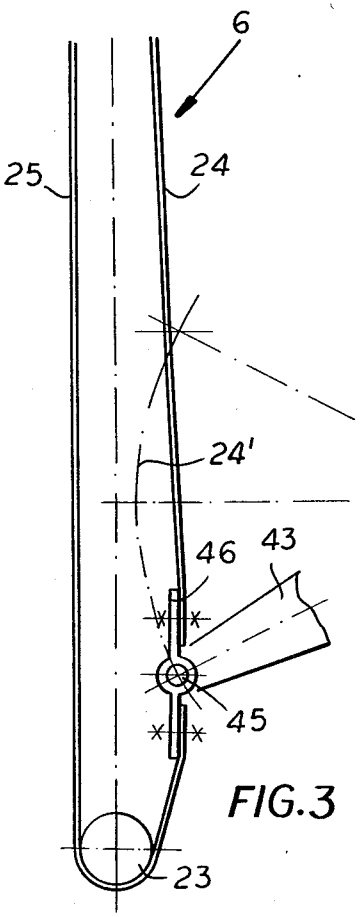

FIGS. 3, 4 and 5 show further possible specific embodiments of the anchorage of the control lever 40 at the end of its other arm 43 with the inner strand 24 of the band means 24, 25 of the respective partial heald 6.

According to FIG. 3, this flexible anchorage is effected by a joint 45 on a crossbar 46, which makes contact with the band means 24, 25. In this case, there ensues by the up-and-down movement of the inner strand 24, a constant deflection of the strand according to the dash-dot line 24' in the representation.

Alternatively, according to FIG. 4, the control lever 40 is flexibly connected with the end of its arm 43 that is fastened to the inner strand 24 of the band means 24, 25 of the respective partial heald 6 to a crossbar 46', which is fastened to the wideband 24', 25', with, then, the joint 45 penetrating through the strand 24' approximately centrally through an appropriate clearance 24''.

If it is desired to prevent occurring deflection of the inner strands also by the arrangement according to FIG. 4, then this can be achieved with advantage in that a connecting rod or a connecting lever 47 is disposed between the joint 45 on the crossbar 46 and the respective control lever arm 43, as can be seen from FIG. 5.

Thus, from the foregoing, there results a shaft driving device on a circular loom of an exceptionally quiet, robust, simple and precise driving conception.

While there are shown and described present preferred embodiments of the invention, it is to be distinctly understood that the invention is not limited thereto, but may be otherwise variously embodied and practiced within the scope of the following claims.

What I claim is:

1. In a circular loom comprising:

a plurality of partial healds arranged circularly around a main loom shaft, each of said healds comprising inner and outer yarn guiding eyes for the guidance of a part of two systems of warp yarn distributed all around said shaft; and sequencing means for imparting up-and-down motion for the formation of a travelling shed, said sequencing means including a plate cam on and revolving with said main shaft of the loom, said inner and outer yarn guiding eyes being connected together by band means, respectively guided over upper and lower guide rollers, the improvement wherein said sequencing means comprise:

at least one two-armed control lever for effecting up-and-down alternating motion of the yarn guiding eyes of each said partial heald, means forming a fixed fulcrum for said control lever, a lever cam on said plate cam in operative connection with an end of one arm of said lever, and means forming a pivot joint with an inner strand of said band means flexibly connected to the end of the other arm of the control lever and including a flat crossbar lying along an inner surface of the inner strand of the band means and with the joint projecting therethrough.

2. The circular loom as defined in claim 1, wherein:

the operative connection between the end of the one arm of the control lever and the cam of the plate cam is formed by a form-closed forced control.

3. The circular loom as defined in claim 1, wherein:

the control lever comprises at least one rolling-off sequential roller, which rolls on the cam on the plate cam at the end of its arm that is in operative connection with the cam.

4. The circular loom as defined in claim 1, wherein:

the control lever is a linear lever.

5. The circular loom as defined in claim 1, wherein:

a connecting rod lever is disposed between the joint on the crossbar and the respective control lever arm.

* * * * *